United States Patent [19]

Naganuma et al.

[11] Patent Number: 5,009,080

[45] Date of Patent: Apr. 23, 1991

[54] LOW-TEMPERATURE SHOW CASE

[75] Inventors: Hiroshi Naganuma; Kenji Sato; Masashi Yamamoto; Toshiaki Kubota; Hiroshige Hayashi; Yoshirou Ishizaka, all of of Gunma, Japan

[73] Assignee: Sanyo Electric Co., Ltd., Osaka, Japan

[21] Appl. No.: 479,390

[22] Filed: Feb. 13, 1990

[30] Foreign Application Priority Data

| | | | |
|---|---|---|---|
| Feb. 16, 1989 | [JP] | Japan | 1-36551 |
| Feb. 27, 1989 | [JP] | Japan | 1-47958 |
| Mar. 9, 1989 | [JP] | Japan | 1-57341 |
| Mar. 28, 1989 | [JP] | Japan | 1-76928 |

[51] Int. Cl.[5] ..... A47F 3/04

[52] U.S. Cl. ..... 62/256; 98/36

[58] Field of Search ..... 62/256, 255; 98/36

[56] References Cited

U.S. PATENT DOCUMENTS

| | | | |
|---|---|---|---|
| 3,059,563 | 10/1962 | Larson | 98/36 |
| 3,145,641 | 8/1964 | Morrison | 98/36 |
| 3,182,467 | 5/1965 | Beckwith | 62/256 |
| 3,211,078 | 10/1965 | Asker | 98/36 |
| 4,148,197 | 4/1979 | Karashima | 62/256 |
| 4,326,385 | 4/1982 | Ibrahim | 62/256 X |
| 4,375,155 | 3/1983 | Rosanio et al. | 62/256 |

*Primary Examiner*—William E. Tapolcai

*Attorney, Agent, or Firm*—Darby & Darby

[57] ABSTRACT

A low-temperature show case comprising an upper case having a front opening to be covered with revolving transparent glass doors, and a lower case having upper opening to be covered with slidable transparent glass doors, said upper case being constructed in the form of oriel with its transparent side walls oriented oblique towards the front opening, and being provided with an outlet for effusing cold air to form an air curtain just behind the opening, the outlet having larger width than the front opening so as to prevent the ambient air to flow into the case.

10 Claims, 17 Drawing Sheets

LOW-TEMPERATURE SHOW CASE

FIELD OF THE INVENTION

The invention relates to an improved dual type low-temperature show case comprising an upper case having, at one end of the show case, a front opening for replenishing and taking goods, and a lower case having an upper opening, said show case having an air curtain formed across the upper opening.

BACKGROUND OF THE INVENTION

There have been proposed various types of low-temperature show cases, each having an opening which is proved for reaching goods therein and is closed with transparent doors and the like, as described in Japanese Utility Model Publication No. 60-1976. Such a so-called reach-in type show case generally employs a forced cold-air circulation system to cool the goods-storing rooms, in which substantially parallel streams of cold air forms an air curtain running, behind the openings, from the upper to the lower portion of the front openings, thereby fulfilling cooling the rooms and, at the same time, shutting the ambient air out of the room even when the front doors are opened. Such air curtains are useful in preventing the rooms to warm up.

The air curtain of the type as disclosed in said Publication, however, has the same or less width compared with the width of the front opening.

Although the cold air is effused uniformly from the outlet, it has a non-uniform transverse distribution of fluid velocity, which is smallest near the side walls due to viscous resistance along the side walls of a show case, and increases towards its center. Such non-uniformity causes disadvantage that the ambient air tends to flow into the case from the sides of the air curtain because the air velocity is low at the edges and the curtain is weak.

Such disadvantage is encountered not only with reach-in type show cases but also so-called open type show cases such as one disclosed in Japanese Patent Publication No. 60-14988, because both ends of an air curtain still contacts with the inner surface of the side walls of the show case.

Such weakness of the air curtain would not be very serious and would not result in warming up of the storing room if the front doors are opened only for a very short period for taking out some goods. However, when the doors are opened for a long period for selecting particular goods or replenishing goods, the ambient air will flow into the storing room undesirably from the side of the air curtain, so that the storing room will be warmed up. This is a more serious problem always encountered with open type show cases than with reach-in type show cases.

A prior art low-temperature show case of this type is also disclosed in Japanese Patent Publication No. 60-14988. FIG. 2 of this Publication shows an art of making holes in rising steps provided on the ceiling board forming a part of the passage of the cold air, said holes also given in the depending portions of the steps. The holes are intended to introduce flows of the cold air into the storing room so as to maintain the temperature of the ceiling board near the holes above the dew point in the storing room and prevent formation of dews on the lower surface of the ceiling board.

In order to provide a greater amount of cold air in the storing room, the depending portion must appreciably extend downwardly. However, this decreases effective volume of the storing room undesirably, since the height of the ceiling must be lowered with reference to the uppermost shelf at least by the vertical size of the holes in the depending portion. This volume loss is not negligible especially as the number of the steps is increased.

On the other hand, if the holes are formed very small in size for the purpose of restoring the height of the ceiling board, the holes may no longer prevent the dews effectively, since then such small holes cannot induce the cold air into the storing room but instead withdraws (or ejects) air from the storing room.

Conventionally, a heating system of this type of show case generally halts its operation during defrosting the ice and frost formed on the refrigeration apparatus as seen in, for example, Japanese Utility Model Early Publication No. 62-80178, which discloses a radiation heater for defrosting installed beneath the refrigeration apparatus, and a conduit inclined towards the drain port of the case provided under the heater for receiving melt frost. Japanese Utility Model Early Publication No. 46-33836 discloses an electric heater mounted on the circumference of the refrigeration apparatus, said heater having a portion protruding downwardly and extending nearly to the drain port.

However, since the heater of the former Publication is arranged beneath the refrigeration apparatus, extending substantially in parallel with the bottom of the refrigeration apparatus, pieces of ice or frost fallen from the refrigeration apparatus tends to accumulate near the drain port located far from the heater and is likely to remain not melted, since the drain port receives less heat than the conduit. Consequently, the remaining ice and frost will continually grow there as the electricity is turned off for defrosting. The growing ice will eventually clog the drain port and paralyze it, which has been a serious disadvantage.

The heater of the latter Publication, on the other hand, can defrost the drain port by means of said protruding portion, but fails to provide sufficient radiation heat uniformly to the frost receiver. Further, the radiation heat is not enough to melt the remaining ice fallen off the evaporator.

Japanese Patent Publication No. 62-1518 discloses a low-temperature show case having a partition wall that extends from the rear wall to the front for partitioning the goods storing room into an upper and a lower storing case, the former of which has a front opening and is cooled by forced circulation of cold air from a refrigeration apparatus, while the latter has an upper opening and is cooled by forced circulation of cold air from a refrigeration apparatus. This show case is reported capable of effectively removing dews generated in the upper storage room during refrigeration.

In order to illuminate the lower storage rooms, most show cases, including the ones mentioned above, utilizes fluorescent lamps installed between the upper and lower storage rooms, or beneath the partition walls. Usually, door-storage sections are formed under the partition walls for storing slidable doors for the opening, and these lamps are often mounted at corners, in general at the front ends, of the storage portions. The presence of such lamp affects the flow of the cold air. The cooled doors cools the door-storage section while they are housed in the storage section. Since the ambient air can easily flow into such door storage section, the region is liable to have significant dews formed therein, which is often. The heat of the lamp, however, is not sufficient to remove the dews formed deep in the storage section. Therefore, some heating means such as an extra heater is needed for removing the dews.

Low-temperature show cases of this type have further difficulty in that, although the heat conduction across the windowpanes is not great, the outer surfaces of the transparent windows are eventually cooled from inside and covered with dews formed thereon as the ambient air contacts the windows. The dews will come down on the surfaces of the transparent windows, and drop onto the floor or onto parts provided in the cases. These dews causes the metal surfaces of the parts to rust or become sources of stain. Hence, most show cases are provided with means for treating such dews, as disclosed in Japanese Utility Model Early Publication Nos. 58-159483 and 62-143175. The former of these Publication teaches a method to remove the dews formed on the transparent windows by leading them into the cold-air passage of the upper storage room. The latter teaches a method of removing the dews formed on the doors by leading them into the cooling chamber.

Although thermally insulated drainage means are provided for leading into said passage the dews formed on the transparent windows, the dews tend to freeze on the internal surface of the inner walls or frost on the portion of the refrigeration apparatus closer to the goods storing room because the dews are cooled by the cold air while they are led into the drainage means through the cold-air passage in the upper storage room. This undesirably causes rather prompt clogging of the passage. Still further, since the cold-air passage of the upper storage room is connected with the lower cold-air passage via the drain passage, dews formed in the upper storage room undesirably tends to frost on the refrigeration apparatus connected with the lower cold-air passage.

On the other hand, the latter has a disadvantage that the dews led into the cooling chamber helps the frost formed on the refrigeration apparatus grow.

BRIEF SUMMARY OF THE INVENTION

In view of the drawbacks encountered with conventional low-temperature show cases, a first object of the invention is to provide a low-temperature show case that is capable of preventing the ambient air from flowing into the case through the opening.

A second object of the invention is to provide a low-temperature show case with its upper-storage room ceiling having a maximum height even when the area of the holes formed in the ceiling are the same as conventional one.

A third object of the invention is to provide a low-tempeature show case having a defrosting apparatus that may desirably melt the frost not only on the refrigeration apparatus but also in the defrosted water receiver.

A fourth object of the invention is to provide a low-temperature show case that is capable of removing the dews formed in a door-storage section without any special heating means.

A fifth object of the invention is to provide a low-temperature show case that is capable of leading dews into an evaporator without exposing them to the cold air.

Firstly, in order to fulfill these objectives, the low-temperature show case according to the invention comprises:

a thermally insulated box having an opening on one side of the box;

a partition board lined along the inner surface of said thermally insulated box;

a cold-air passage formed inbetween said thermally insulated box and said partition board, and having an outlet and an inlet facing with each other at opposite ends of said opening, and a refrigeration apparatus and a blower;

a goods-storing room surrounded by said partition board; and a cold-air curtain established between said outlet and said inlet, covering said opening, characterized in that the width of said outlet is greater than that of said opening.

Both edges of the air curtain have extremely low velocity compared with the central stream of the curtain due to viscous resistance along the side walls. By making the transverse width of the cold air outlet greater than the width of the opening, these edges of the air curtain run outside the opening without touching the right and left corners of the opening, thereby preventing the ambient air from flowing into the opening, unaffected by the non-uniform velocity distribution of the air stream, thereby reducing humidity and warming up of the goods-storing room. The air curtain thus formed may fulfill its function to maintain the storing room at a desired low temperature by preventing infiltration of the ambient air.

In this case it is preferable to form oblique walls on the front ends of the opposite side walls of said thermally insulated box, said oblique walls being at least partially transparent, narrowing towards the opening so as to enclose the opposite edges of the opening, and being in contact with opposite edges of the air curtain.

By covering the edges of the opening with the side walls in this way, it is possible to shut the ambient air off the edges of the air curtain having very low fluid velocity. Such partially transparent side walls permits the goods in the storing room to be seen from outside and may increase displaying function of the show case.

It is desirable to form a step or steps on the ceiling board in such a way that the upper level board of each step is located in the downstream of the air passage and the lower level in the upstream, and that a multiplicity of holes are formed in the depending portion of the step, extending into at least one of the upper and lower level boards.

By forming such holes extending from the depending portion into at least one of upper and lower level ceiling boards, it is possible to reduce the height of the depending portion, or increase the height of the ceiling of the storing room, compared to one having holes of the same shape and size not extending out of the depending portion. This makes it possible to restore the decrease in volume of the storing room. Further, such holes extending into the upper and/or lower ceiling boards enhance the air flow through the corner of the step and contribute to prevent stagnation of the cold air in the corner, thereby preventing generation of dews on the lower surface of the ceiling boards.

Also, inside the thermally insulated box, it is desirable to provide a sloping conduit, under the refrigeration apparatus, sloping towards a drain port, and a defrosting heater between said sloped conduit and said refrigeration apparatus, with its horizontal portion just beneath the lower surface of said refrigeration apparatus and a sloping portion extending from the horizontal portion substantially in parallel with said sloped conduit.

By providing such sloping conduit and such heater extending in parallel with the sloped conduit as well as lower surface of the refrigeration apparatus, a gap between the heater and the sloped conduit is substantially constant, and as a result uniform radiation heat is given to the sloped conduit and the drain port so that the frost and ice formed at and near the conduit and the drain port may be effectively melt in a short period of time.

Further, since the refrigeration apparatus is heated by not only the radiation heat from the horizontal portion but also the radiation heater from the sloped portion and the convection heat of the warm air heated by the sloped heater, the frost and ice formed on the refrigeration apparatus may be melt efficiently, and hence defrosting efficiency is improved.

The low-temperature show case according to the invention has a feature that the show case comprises:

a lower case having an upper opening which is formed in the upper front half end of the case, and is closed by transparent doors which are slidable back and forth;

an upper case located above the upper rear half end of said lower case, and having a rear end further behind the rear end of the lower case and a bottom;

a door-storage section for storing said doors, located in between the upper and lower cases and having an illumination means at its front end;

a left and a right walls forming the sides of both the upper and lower cases;

a rear wall and a bottom of the lower case;

a machinery room under the lower case, for accommodating a compressor and a condenser constituting a part of a refrigeration system for cooling at least the lower case; and an air passage communicating with the door-storage section and the machinery room, for introducing warm air from the machinery room into the door-storage section.

The air passage makes it possible to allow the heat generated by the illuminating lamp during its use to escape from the illumination block, and, when the lamp is not in use, to prevent formation of dews in the illumination block by the circulation of the warm air heated through heat exchange in the machinery room. Since the air warmed in the machinery room is dried, it may dehumidify the air passage. The warm air may dehumidify the air passage and may be further used to warm the drain pipe of the upper storing room. The use of this warm air, which has been abandoned so far, permits elimination of an extra heating means that is otherwise required for completely removing frost and dews in the show case.

The low-temperature show case according to the invention also has another feature that the case comprises:

an upper case having transparent revolving doors at the front end of the show case;

transparent side windows; and a frame having troughs for receiving the lower end of said transparent windows; and a lower case having transparent slidable doors on the upper front end of the lower case;

sloped dew guiding grooves which are formed on the side walls and to the right and left ends of said transparent doors, just below said frame, and sloping down towards the front of the case;

style frames covering said dew guiding grooves; and a drain pipe with its upper end connected with said dew guiding grooves, and the lower end connected with a drain water tray provided in the machinery room.

The upper case may be further provided with frames for receiving dews formed on, and dropping from, the transparent windows of the upper case, and lead pipes connected with said frames for leading the dews into the dew guiding grooves.

The dews formed on the transparent windows of the upper case may be thus led into the dew guiding grooves through the frames and the guide pipes without being exposed to the cold air in the lower case, and hence do not freeze on the walls or on the refrigeration apparatus.

There may be provided on the upper portions of the right and left side walls of the upper case a right and a left frames, respectively. Preferably, dew guiding grooves, covered with external style frames and sloping down towards the front, are provided on the upper end of the lower case, and with rail receivers inside the case for receiving the lower end of rails supporting the transparent slidable doors.

In this case, the dew guiding grooves are formed so as to collect the dews deposited on the transparent doors of the lower case in a dew receiving portion provided at each end of the dew guiding grooves.

Therefore, the dews coming down through the dew guiding grooves are less likely to be in contact with the surrounding cold air. In addition to keeping the inner and outer boxes of the lower case thermally insulated, the right and left frames thus serve to receive the rails and to convey dews.

DETAILED DESCRIPTION OF THE PREFERRED EMBODIMENT

Figure 1:
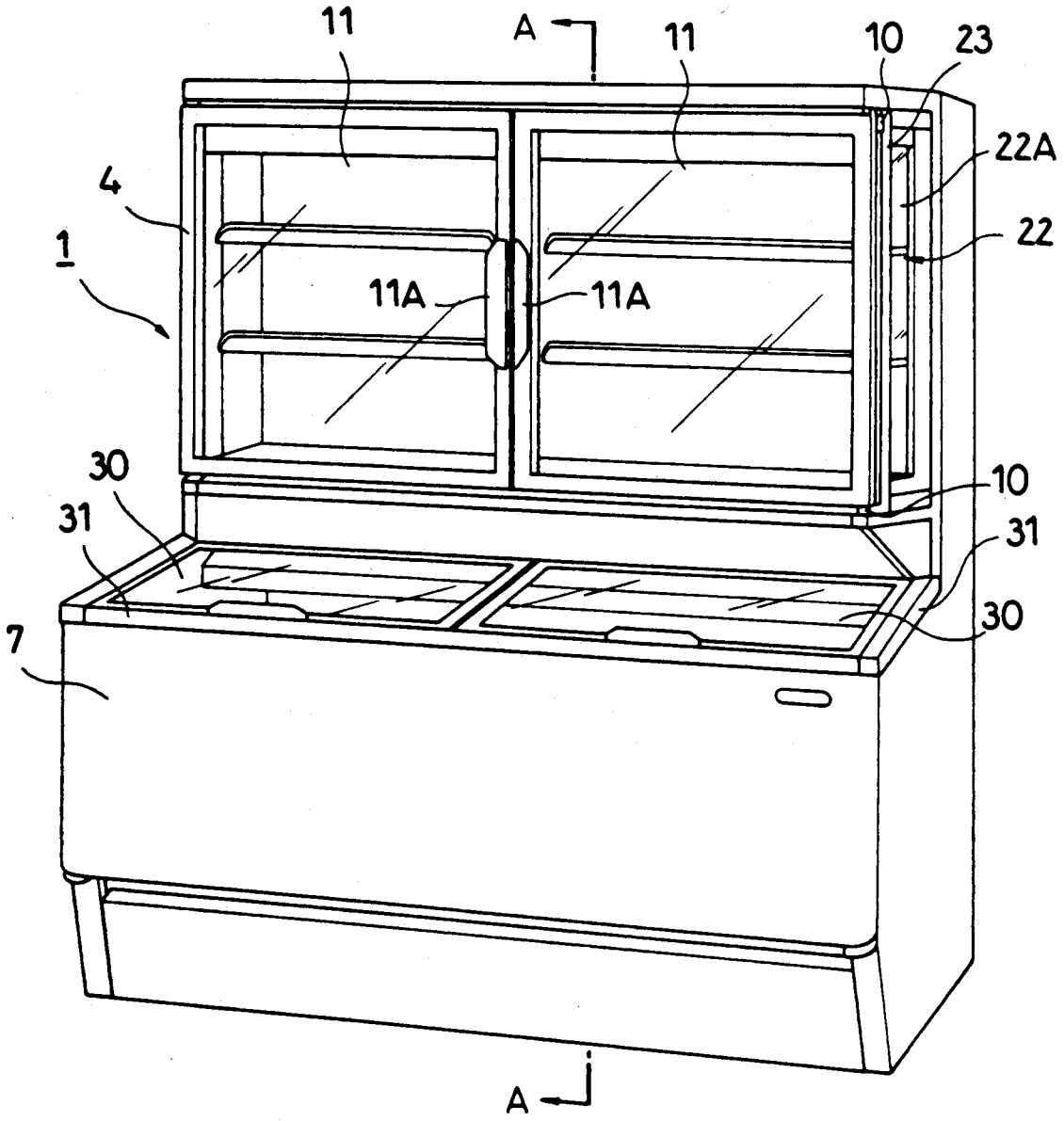
FIG. 1 is a perspective view of one embodiment of the low-temperature show case according to the invention.
Figure 2:
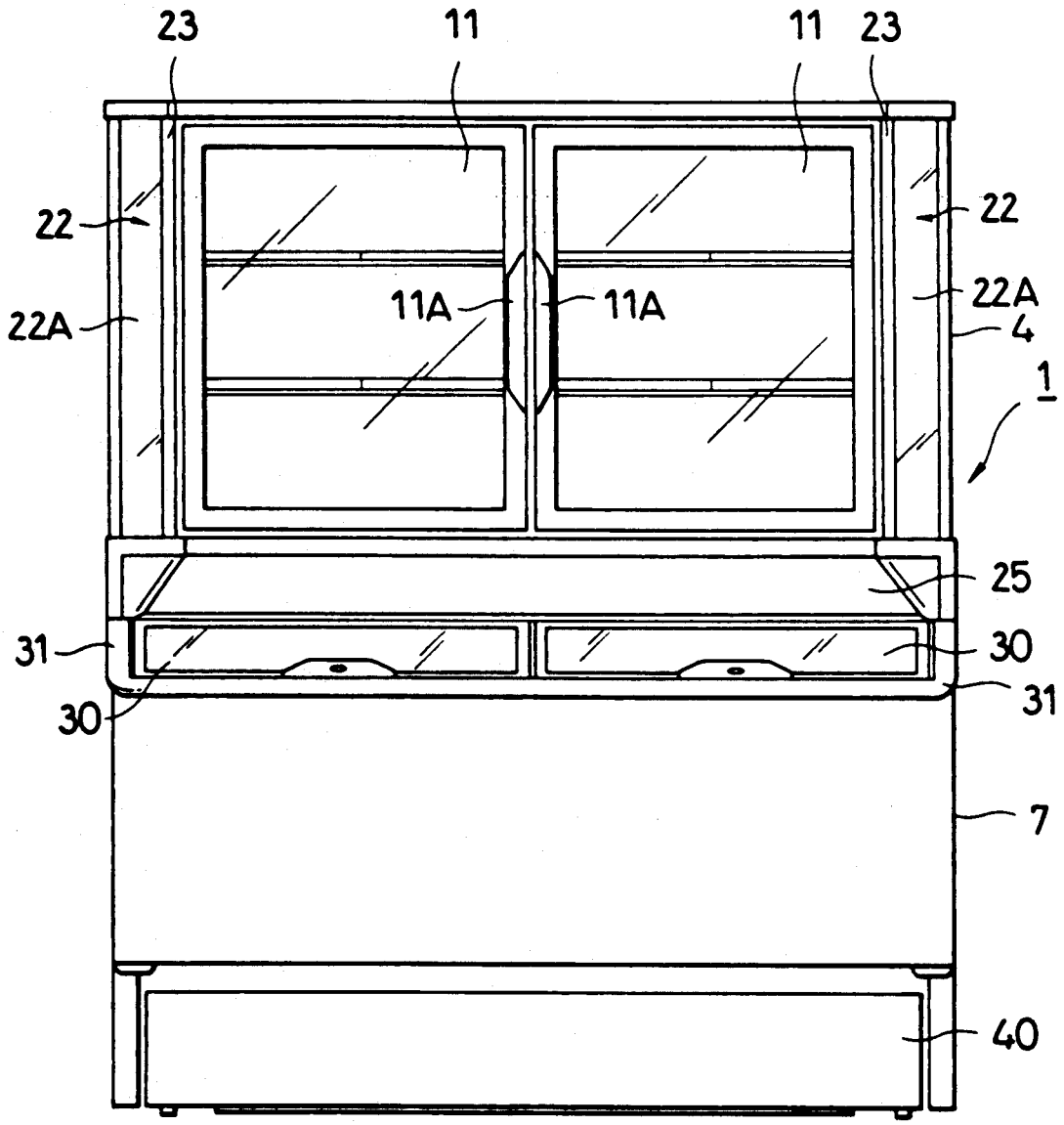
FIGS. 2 and 3 are a front view and a side view of the low-temperature show case, respectively.
Figure 3:
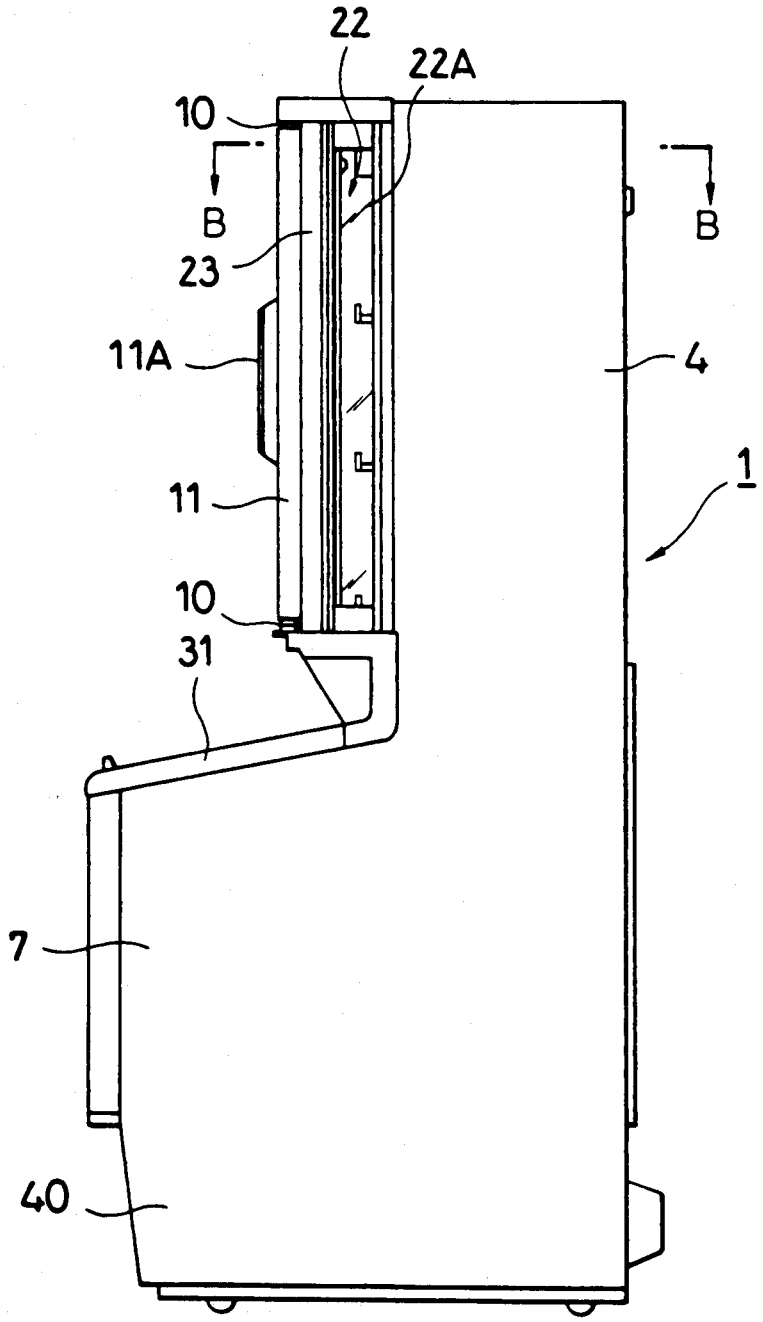

A so-called dual type low-temperature show case 1, such as shown in FIGS. 1 through 5 comprises an upper case 4 having a front opening 2 for replenishing and taking out goods, and thermally insulating walls 3; and a lower case 7 having an upper opening 5 for replenishing and taking out goods, and thermally insulating walls 6.

The upper case 4 comprises: a pair of transparent doors 11 in front of thermally insulating walls 3, each of said doors being pivotally supported by a pair of upper and lower hinges 10 and having handle 11A; a goods-storing room 16 (used for refrigerated goods in this example) having metal partition panels 12 and bottom panel 13, separated at a suitable distance from the insulating wall 3, a multiplicity of shelves 14, and a fluorescent lamp 15; a cold-air passage 19 formed of partition panels 12, the bottom panel 13, and the insulating walls 3, and including a plate-fin type refrigeration apparatus 17 and a blower 18; and a cold air outlet 20 and an opposing suction inlet 21 located inside and along the upper and lower edges of the front opening 2, respectively.

Figure 6:
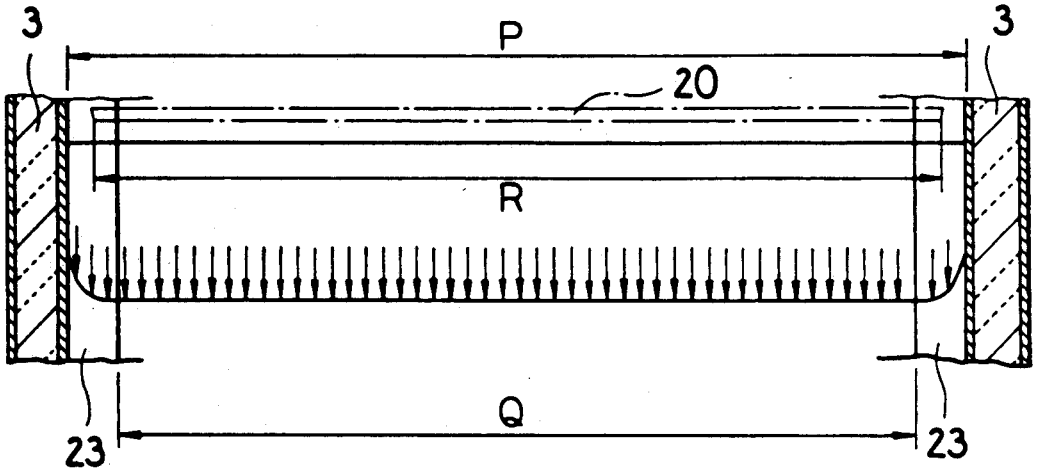
FIG. 6 illustrates the velocity distribution of the cold air effused from the cold-air outlet of the low-temperature show case.
Figure 7:
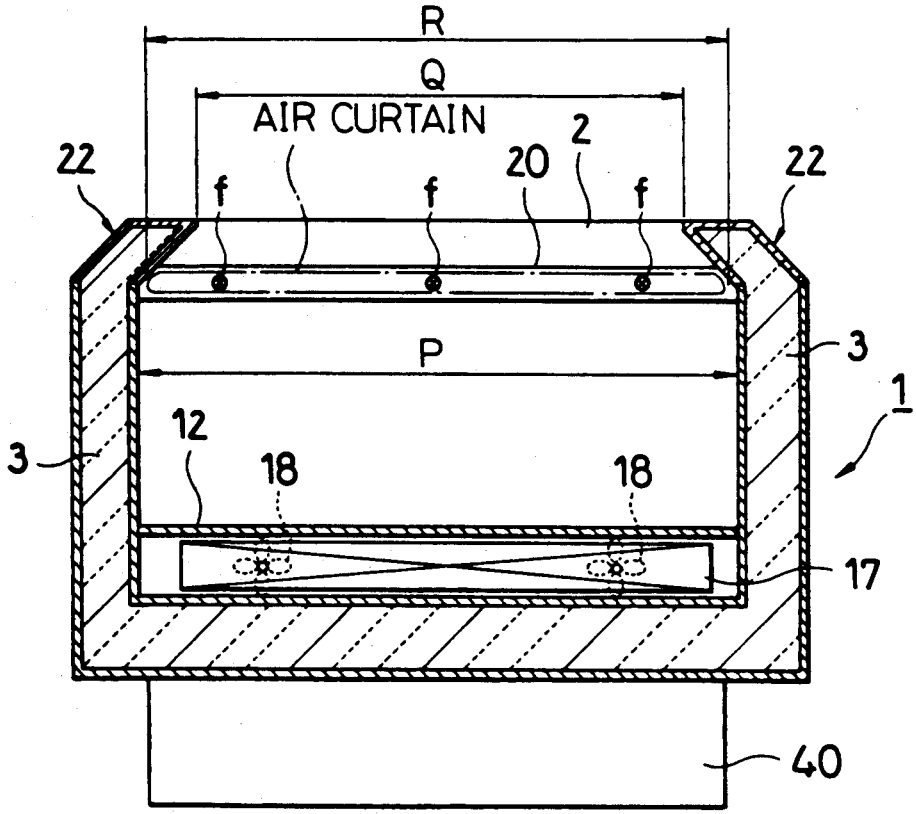
FIG. 7 illustrates some internal constitution of another flat open type low-temperature show case embodying the invention.
Figure 8:
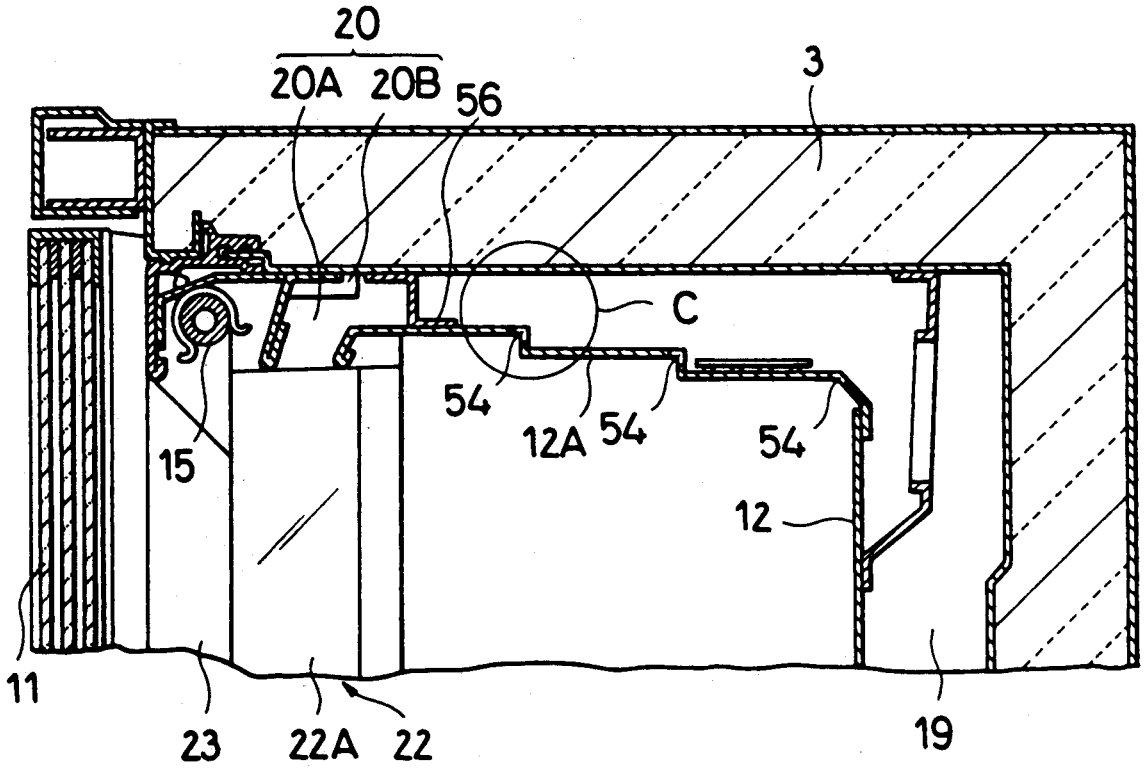
FIG. 8 is a fragmentary enlarged view of the upper portion of the first embodiment of the low-temperature show case.

At the front ends of the right and left thermally insulating walls 3, there are angular walls 22 (which are hereinafter referred to simply as transparent walls when they are made in form of transparent windows 22A) formed at an obtuse angle to said side walls to constitute a part of an oriel, extending inwardly towards the front opening and contact with the opposite edges of the air curtain described below and as shown in FIG. 6. The angular walls 22 in a single-deck show case described later also extends substantially horizontally along the edges of the air curtain as shown in FIG. 7. In this case the front width Q of the opening of the upper case is made smaller than the interval P between the opposed inner surfaces of the insulating walls 3 (or the width of the goods storing room 16), while the transverse width (or horizontal length) R of the outlet 20 is made larger than the front width Q.

Figure 4:
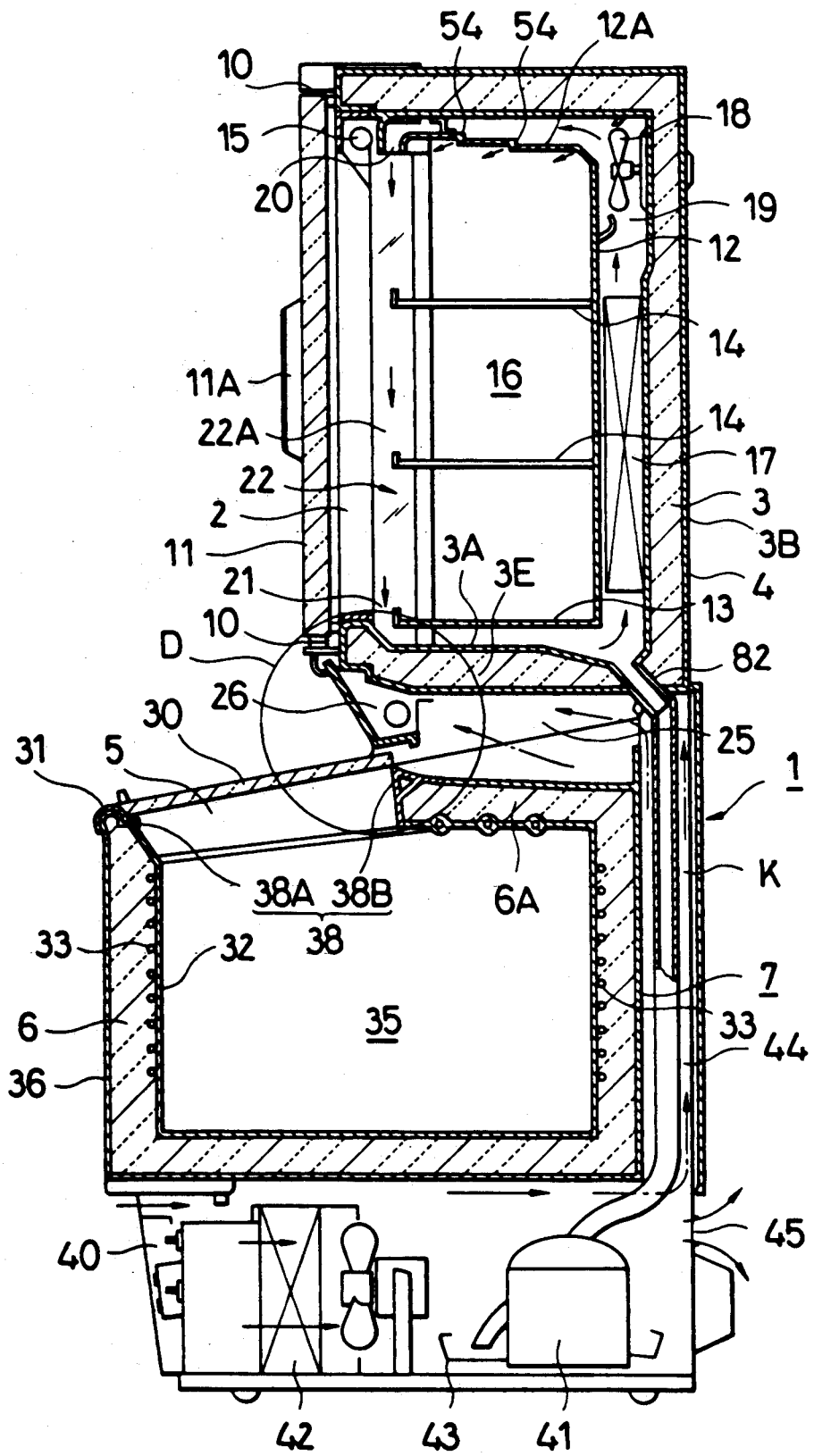
FIG. 4 is a cross sectional view taken on line A—A of FIG. 1.
Figure 5:
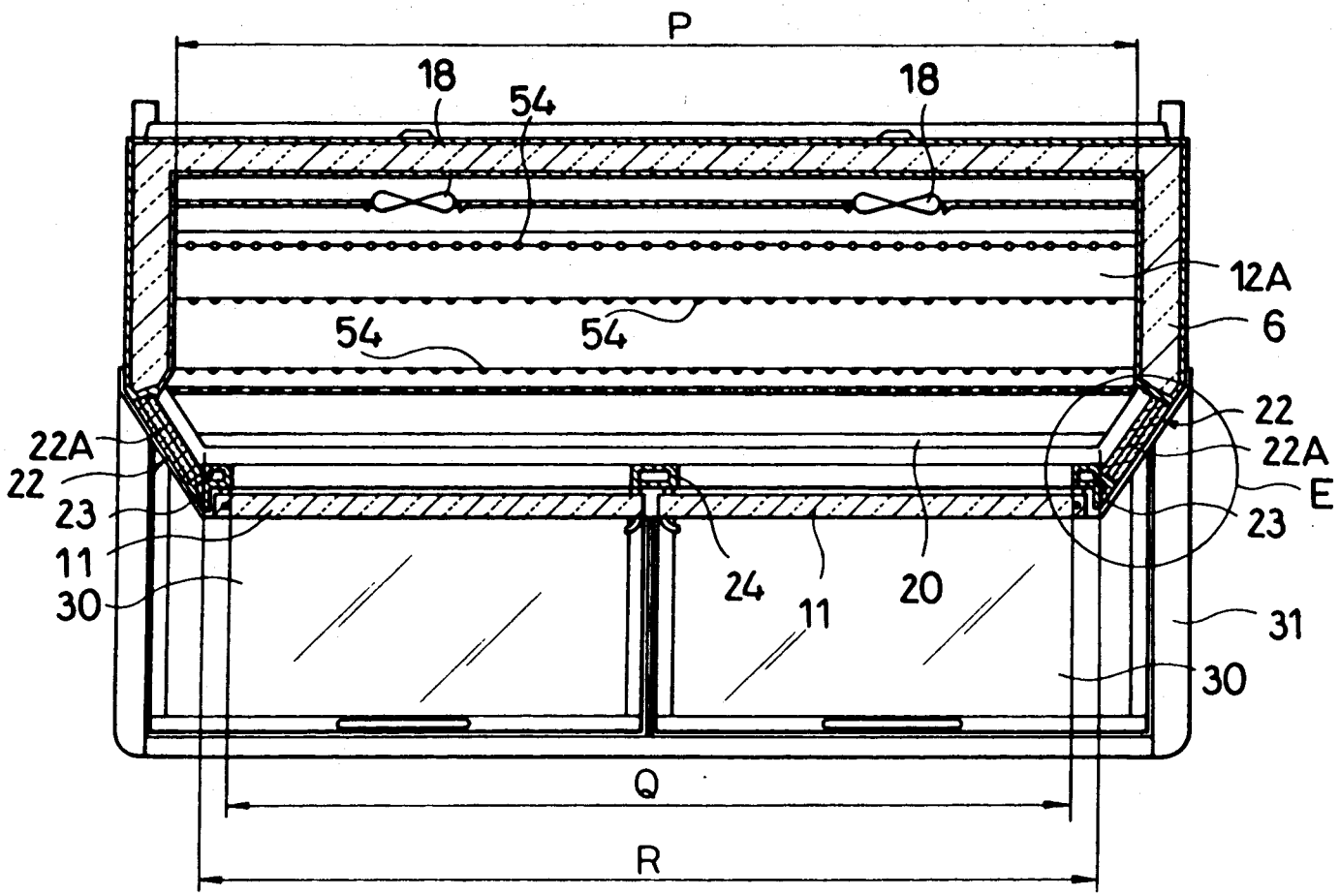
FIG. 5 is a cross sectional view taken on line B—B of FIG. 3.

As shown in FIG. 4, the air which has given off heat in the refrigeration apparatus 17 (which is hereinafter called cold air) is forcibly circulated by means of a blower 18 as shown by arrows, and as it effuses from the outlet 20 to the inlet 21 it establishes an air curtain behind the transparent doors 11, which cools the goods-storing room 16. The vertical edges of the curtain are adapted to be in contact with the inner surfaces of the transparent windows 22A, as described above.

The insulating wall 3 comprises: an inner box 3A having a front opening and made of metal such as melt-zinc coated steel plate; an outer box 3B made of metal such as melt-zinc coated steel plate, also having a front opening, and accommodating said inner box at a suitable distance from the outer box; and space-filling formed insulating material of closed cell type such as rigid polyurethane foam injected into the space between the two boxes 3A and 3B.

Beneath the bottom wall 3E of the insulating wall 3 is a door-storage section 25 which also functions as an illumination box. The illumination block 26 or the front end of the illumination box is provided with a fluorescent lamp for illuminating the goods-storing room of the lower case 7. The door-storage section can accommodate the slidable doors 30 of the lower case as described later.

The lower case 7 comprises: a ceiling board 6A located at the rear end of upper opening 5 of the insulating wall 6; two transparent doors 30 which are sloped down towards the front and slidable back and forth; style frames made of light metal such as aluminum for decorating three sides of the opening 5 of the insulating wall 6. The front style board has a rail-shaped handle 31 (described in more detail later). The freezer room 35 is refrigerated by natural convection of the air cooled by heat exchange with a pipe-on-sheet type main refrigeration apparatus 33 installed outside the inner box 32 (which constitutes the inner wall of the insulating wall 6) and a roll-bond-type auxiliary refrigeration apparatus 34.

The insulating wall 6 comprises: an inner box 32 having an upper opening and made of metal such as melt-zinc coated steel plate; and an outer box 36, also having an upper opening, made of metal such as melt-zinc coated steel plate and accommodating said inner box at a proper distance from the outer box; and breakers 38 (to be described later) extending over the upper space between the two boxes to cover the space; and space-filling formed insulating material such as rigid polyurethane foam injected into the space between the two boxes 32 and 36. One end of the box (which is the upper end in this example) is left as an opening 5 for replenishing and taking out goods. The portion 6A extending over the upper opening 5 constitutes a part of the ceiling of the lower case.

The goods-storing room 35 inside the inner box 32 is cooled by means of the pipe-on-sheet main refrigeration apparatus 33 and the slab-shaped auxiliary refrigeration apparatus 34 mounted on the rear half of the upper ceiling. The auxiliary refrigeration apparatus may be formed in a so-called roll-bond method.

In the machinery room 40 under the insulating wall 6 are:

a first compressor 41 and a first condenser 42 which, together with a plate-fin type refrigeration apparatus 17, constitute a refrigeration cycle for the upper case 4; and a second compressor and a second condenser which, together with the main and auxiliary refrigeration apparatuses 33 and 34, constitute another refrigeration cycle for the lower case. (The second compressor and the second condenser are both behind the first compressor 41 and the first condenser 42 and not shown in the figure.)

The upper case 4 is constructed in such a way that the front end of the insulating wall 3 is located at about the center of the upper end of the lower case 7, but the rear end of the bottom wall is located further behind the rear wall of the insulating wall 6 of the lower case 7, and the side walls of the upper case are integral with those of the lower case.

The constitution of the portion near the outlet 20 of the upper case 4 is now described. Door abutting frames 23 which also serves as door supporting braces are mounted on the front ends of the transparent windows (of the oriel) 22A fixed on the front ends of the insulating wall 3 of the upper case 4. There are revolving transparent doors 11 pivotally mounted on the door abutting frames 23, for closing the opening 2 of the upper case 4. The doors have handles 11A and the inner surfaces of the door abut braces 24.

As will be described in detail, the ceiling board 12A of the partition panel 12 comprises steps of substantially level portions parallel with the general stream line 19 of the cold air, and depending portions between said level portions, the steps rising towards the downstream of the cold air. A multiplicity of holes 54 having appropriate configuration are formed to extend from the depending portions into the level portions.

These holes 54 introduces a part of the cold air from the cold air passage 19 into the goods-storing room 16 along the lower surface of the ceiling board 12A of the partition panel 12, preventing generation of dews on the surface. By forming the holes 54 in this manner across the corners of the steps, the height of the depending portions may be reduced compared with those having holes only in depending portions if the area of the holes are the same. Then the height of the ceiling, and hence the volume of the storing room 16, are increased accordingly.

The transverse width R of the outlet 20 is made greater than the horizontal width Q of the opening 2 defined by the door abutting frames 23, by the amount of about 20 mm on each side of the opening. The distribution of the fluid velocity in the air curtain under this condition is shown in FIG. 6.

By extending the horizontal dimension of outlet 20 of the cold air on both sides by 20 mm over the horizontal dimension of the front opening 2 of the box, the velocity distribution in the air curtain just behind the opening may be made uniform, which makes it possible to prevent infiltration of the ambient air from the edges of the curtain into the room while the doors are opened, thereby preventing warming up and humidification inside the goods-storing room. The uniformity in the velocity distribution of the air also enhance the cooling function of the air curtain. The transparent oblique side windows 22A increase visibility of the room from not only the front but also oblique directions, which is useful for the show case.

The oblique transparent windows 22A provided on the front ends of the insulating wall 3 encase the slow edge portions of the cold air effused from the outlet 20. This also contributes to prevent the infiltration of the ambient air from the opposite ends of the opening 2 into the room.

Although the invention has been described above concerning upright show cases having doors, the invention may be equally applied to multi-deck open show cases having no door, and to single-deck open show cases as shown in FIG. 7. It is noted here that in FIG. 7, marks f indicate the flow of cold air directed into the paper.

The structure of the ceiling board 12A of the partition panel 12 is now described in detail, with reference to FIG. 8 through FIG. 13.

Figure 9:
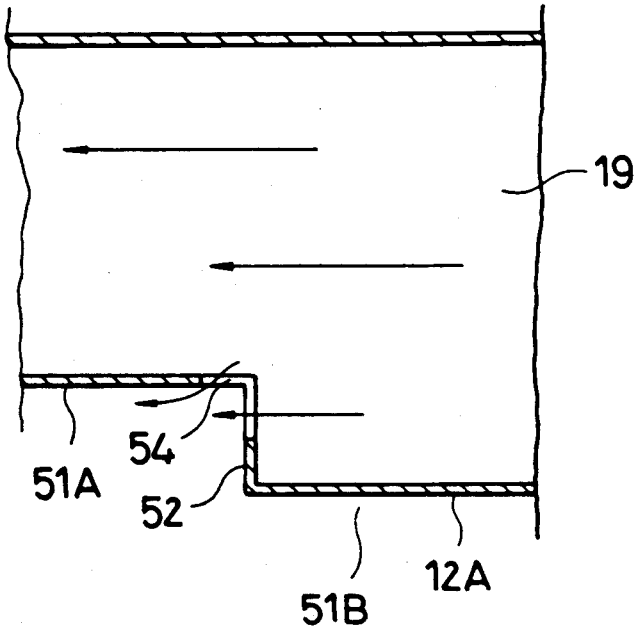
FIG. 9 is a fragmentary enlarged view of the section C of FIG. 8.
Figure 10:
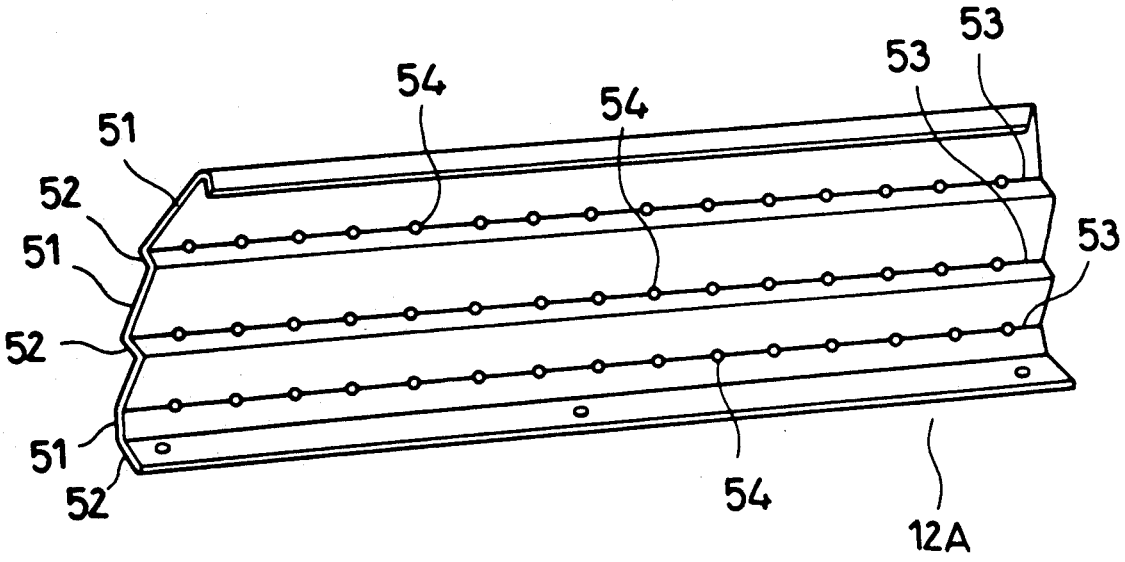
FIG. 10 is a perspective view of the ceiling board of the low-temperature show case of FIG. 8, viewed from the bottom.
Figure 11:
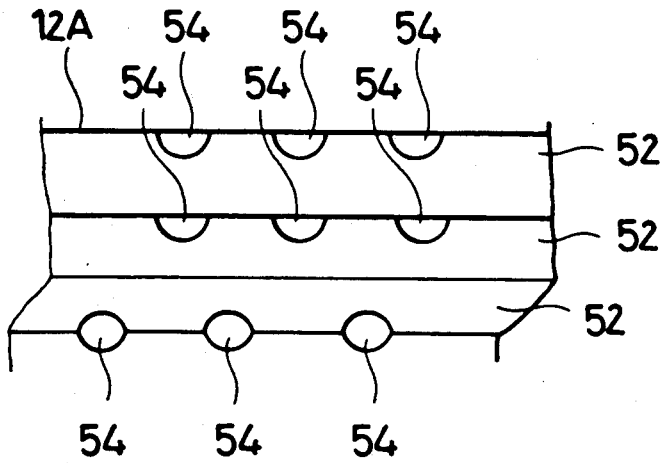
FIGS. 11, 12, and 13 illustrate the holes formed in the ceiling board.
Figure 12:
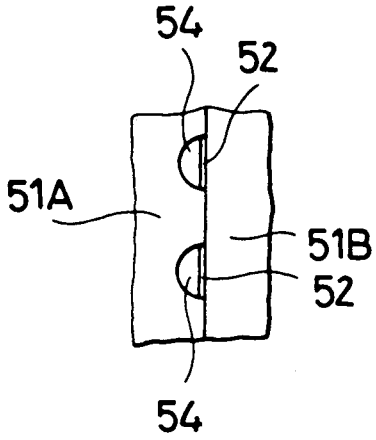
Figure 13A:
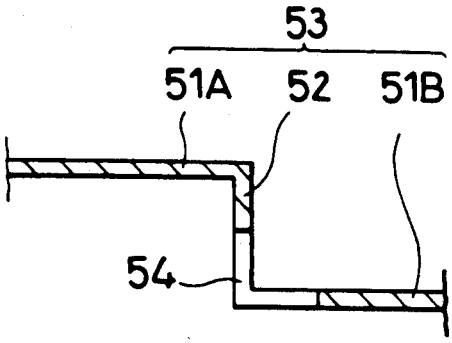
Figure 13B:
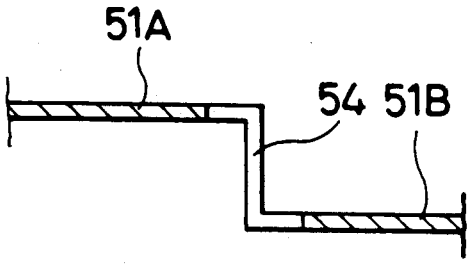

The ceiling board 12A comprises depending portions 52, upper portions 51A which are substantially level and extending away from the depending portion towards the downstream of the main cold air, and lower portions 51B which are also substantially level and extending away from the depending portion towards the upstream of the main stream. As shown in FIGS. 9 and 13, there are provided in at least one of upper and lower portions and in the depending portion a multiplicity of holes 54 having appropriate configuration (which is round in this example).

As mentioned earlier, these holes 54 are intended to introduce a part of the cold air from the cold air passage 19 into the goods-storing room 16 along the lower surface of the ceiling board 12A of the partition panel 12, thereby preventing generation of dews on the surface. By forming the holes 54 in the corners of the steps 53 made up of portions 51A, 51B, and 52, the height of the depending portions may be reduced compared with those having holes only in either portions if the area of the holes are the same, thereby increasing the height of the ceiling and the volume of the storing room 16 accordingly. Further, these holes (extending from the depending portions to the level portions) permit the air to flow therethrough into the corners and eliminate stagnation of the air, which would otherwise takes place.

Between the farmost front portion 51 and the outlet 20 is provided a multi-hole panel 56 serving as a current regulator for decreasing the flow rate at the outlet 20 of the cold-air passage 19. The outlet 20 comprises a main outlet port 20A for forming the air curtain downwardly thereof, and small auxiliary outlet ports 20B directed to the transparent windows 22A for preventing clouding of the transparent windows 22A.

Thus, by forming the holes 54 in the corners of the steps made up of portions 51A and 51B extending in the downstream and upstream of the depending portion 52 of the ceiling panel 12A, respectively, the height of the depending portions may be reduced compared with those having holes only in either portions if the area of the holes are the same, thereby increasing the height of the ceiling and the volume of the storing room 16 accordingly. Further, since these holes extend from the depending portions to the level portions the air is permitted to flow therethrough into the goods-storing room 16 and eliminates stagnation of the air in the corners of the steps, thereby preventing the generation of the dews in these corners.

Figure 14:
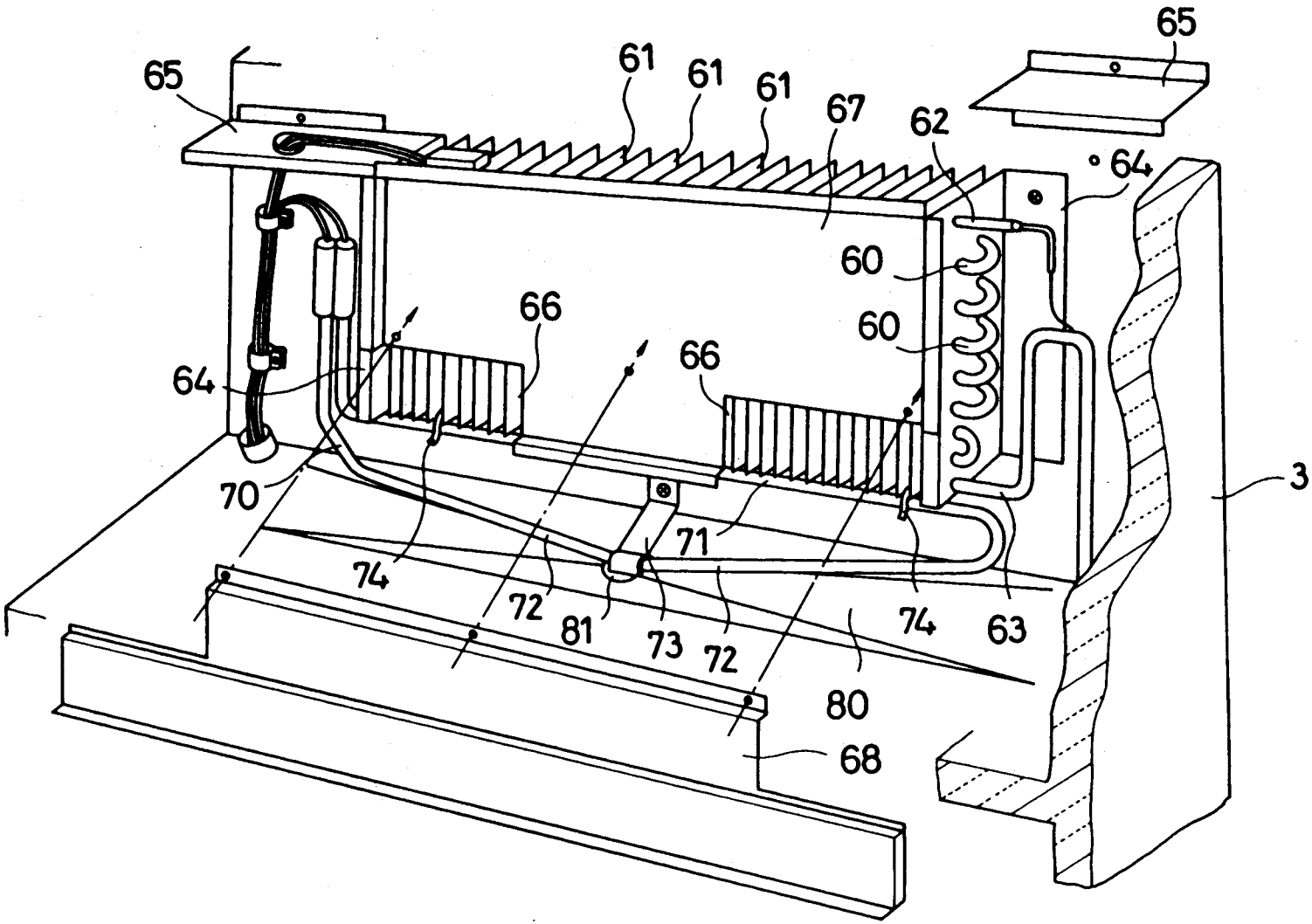
FIG. 14 depicts the spatial relationships among the refrigeration apparatus, defrosting heaters, and a sloped conduit provided in the upper case.
Figure 15:
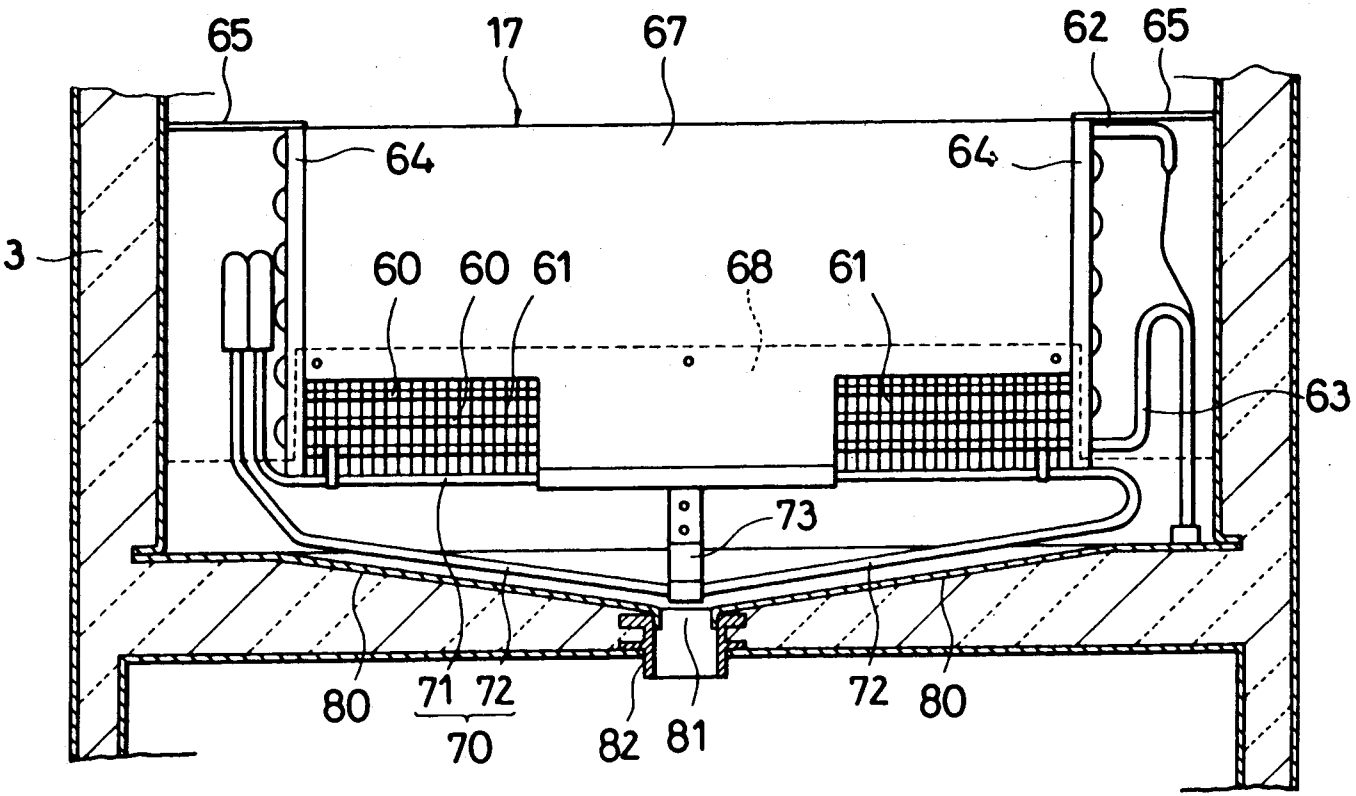
FIG. 15 is a partial front view of the first low-temperature show case with its partition board near the refrigeration apparatus removed.
Figure 16:
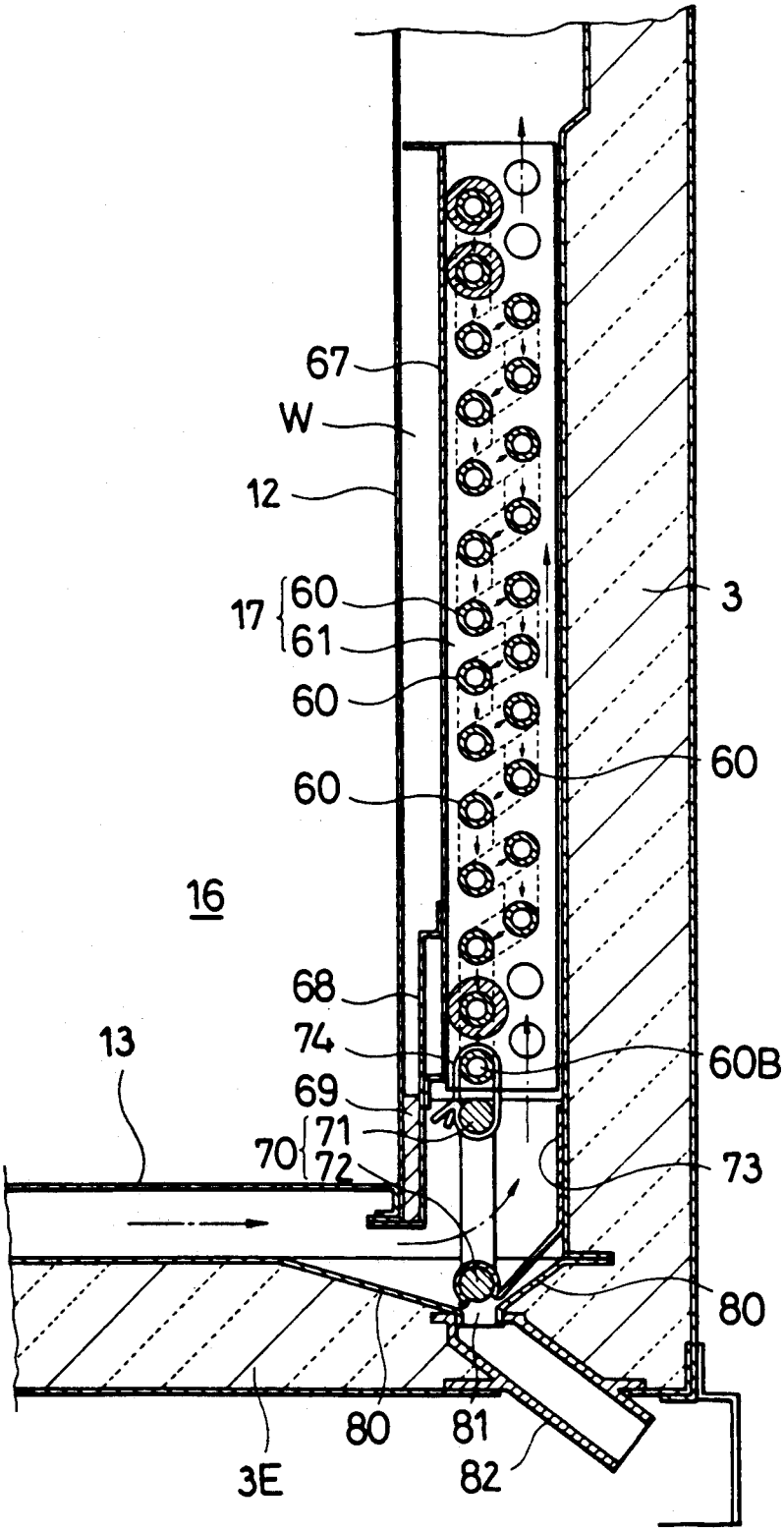
FIG. 16 is a vertical cross section of the first low-temperature show case near the refrigeration apparatus.

Referring now to FIGS. 14 through 16, the structures of the refrigeration apparatus 17 and nearby elements are now described. The refrigeration apparatus 17 comprises a refrigerant pipe 60 which zig-zags in the apparatus forming double layers of parallel piping, and a multiplicity of heat exchanging fins 61 made up of substantially the same shape of equally spaced aluminum plates arranged to transversely cross the pipe 60. The refrigerant pipe 60 comes from one end to the other of the refrigeration apparatus and goes back therethrough in parallel with the coming portion but shifted up and aside a little, until it finally comes out of the apparatus at the exit (62) as best shown in FIGS. 14 and 16.

The inlet 62 and the outlet 63 are in the same vertical plane. The refrigerant flows from the above positioned inlet 62 to the low positioned outlet 63. Since the air to be cooled is passed through the apparatus from the bottom to the top thereof, the pipe supporting panel 64 is held upright, so that the bottom of the fins must be higher than the lower end of the partition panel 12. Partition panels 65 are provided, each extending between one end of the panel 64 and the insulating wall 3 so that the panels may retain warm air during defrosting. At the front end of the refrigeration apparatus 17 is a front cover 67, a part of which is cut away to permit ventilation for preventing the lower portion of the apparatus from being clogged with frost. A lower cover 68 is mounted below the front cover 67 so as to form an insulating space W between the front cover 67 and the partition panel 12. An insulating member 69, supported by the lower cover 68 and the partition panel 12, prevents the heat passage from the heater to the goods-storing room during defrosting.

A defrosting heater 70 is provided just beneath the refrigeration apparatus 17. The heater 70 has a horizontal portion 71 lying directly below the refrigerant pipe 60B and a sloped portion 72 extending in parallel with a sloping conduit 80 provided at the bottom of the inner box. The sloped portion 72 reaches its lowest position just above the drain port 81. The lowest portion of the sloped portion 72 is supported with a holding member 73 just above, and close to, the drain port 81. The horizontal portion 71 is hung from the lowest refrigerant pipe 60B by means of holding bands 74. In order to control electricity through the heater, a temperature sensor is provided near the air exit of the refrigeration apparatus.

The drain port 81 is connected with a drain pipe 82 which penetrates the bottom wall 3E of the insulating wall, which pipe is in turn connected with a lead pipe 44 reaching the drain water tray 43 in the machinery room 40 through an intervening space K.

By providing such a refrigerant pipe of single layer near the air intake of the refrigeration apparatus 17 where the pipe is coldest and most likely to accumulate frost, it is easier to prevent clogging with frost of the air intake than in the case of double-layer refrigerant pipe if frost is deposited on the refrigerant pipe. Besides that, since the front cover has cut away portions 66, clogging of the apparatus is less likely to happen on the air intake side. It is noted that the defrosting heater 70 provided beneath the refrigeration apparatus 17 comprises the horizontal portion 71 and the sloped portion 72 extending in parallel with the sloping conduit 80 under the inner box, and that the distance of the heater from the sloping conduit 80 is kept constant over the entire length, and further that the lowest end of the heater is located just above the drain port 81. Hence, the radiation heat generated by the heater 70 is directed uniformly not only to the refrigeration apparatus 17, but also to the frost deposited on the sloping conduit 80 in the show case, thereby eliminating ices remaining in or near the drain port 81.

Furthermore, an ascending current of air (indicated by broken line arrows in FIG. 16) is generated by the radiation heat from the horizontal portion 71 as well as the radiation heat from the sloping portion 72, which current also heats the refrigeration apparatus 17 (particularly refrigerant pipe 60), so that frost and ice deposited on the refrigeration apparatus 17 may be defrosted efficiently in a short period of time. In other words, clogging of the refrigeration apparatus 17 is less likely on the air intake side.

As shown in FIG. 4, a lower portion of the drain pipe 82 projects, behind the door-storage section 25, and penetrates the bottom wall 3E so as to drain defrosted water from the plate fin type refrigeration apparatus 17 of the upper case 4. The drain pipe 82 is connected to the drain water tray 43 in the machinery room via the lead pipe 44. The machinery room 40 communicates with the space K, which space K in turn communicates with the door-storage section 25. Warm air generated in the machinery room is divided into a given proportion of air to be exhausted from the machinery room through an exhaust 45 at the back of the machinery room 40 (indicated by solid arrows in FIG. 4), and a rest portion to be led to the illumination block 26 through a warm air passage past a lower part of the rear cover, the space K, and the door-storage section 25. The proportion of these warm air is about 9:1 in this example). The warm air flowing into the door-storage section 25 may be utilized to heat a drain pipe therein, as described later.

Figure 17:
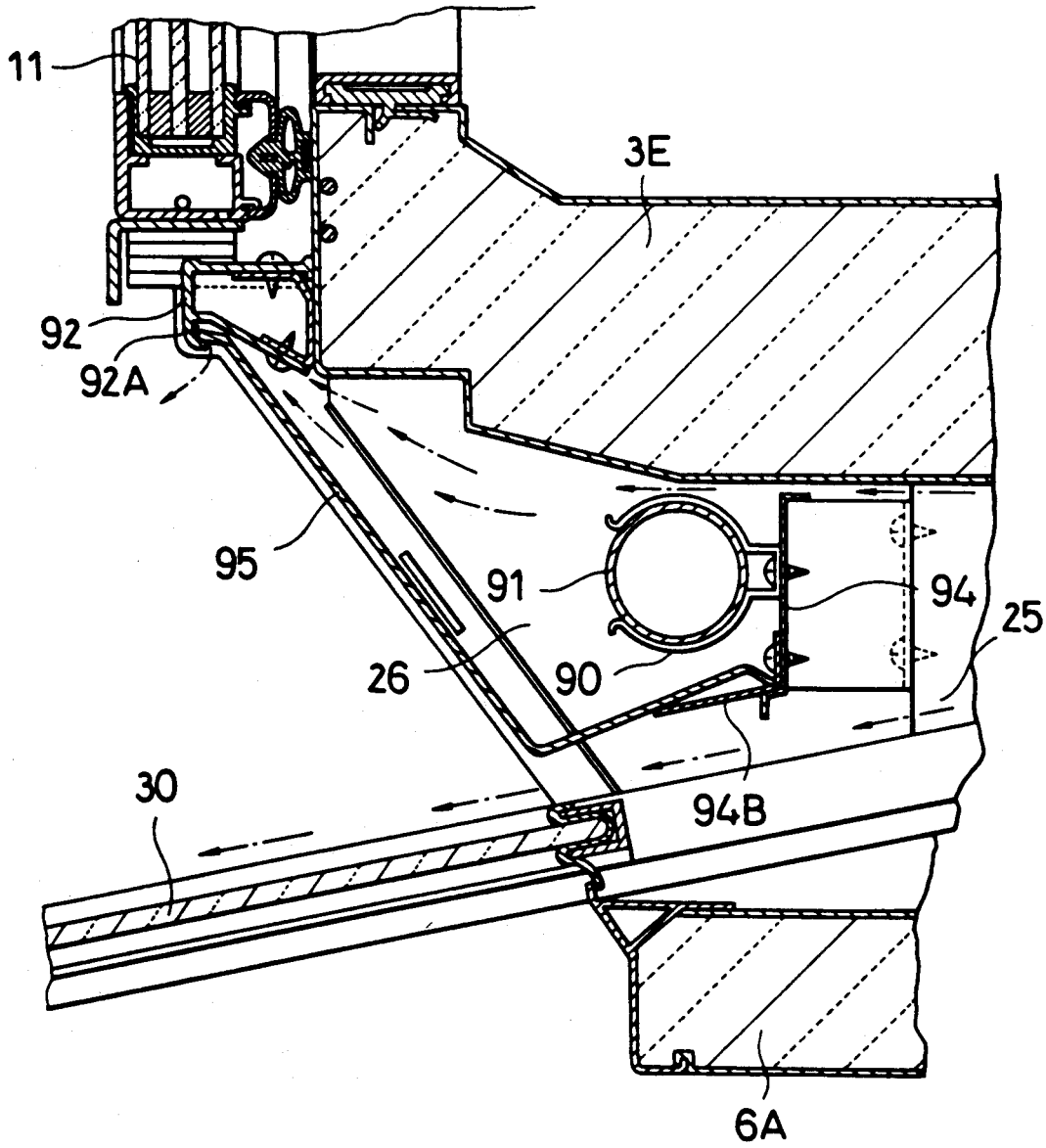
FIG. 17 is an enlarged view of the section D of FIG. 4.

On the other hand, the illumination section 26 is mounted on a front lower surface of the bottom wall 3E of the thermally insulating wall 3, with its length being in parallel with the front end of the show case. As shown in FIG. 17, the illumination block 26 includes a fluorescent lamp 91 which is removably mounted on a clip 90, and a flexible, light-transmitting plastic shade 95 with its lower end mounted on a fixed piece 94B of a fixed member 94 fixing the clip 90, and its upper end engaging with an engaging groove 92A of a horizontal dew-receiving beam 92 for securing the hinge, under the transparent doors 11. It is desirable to give the fixed piece 94B resiliency. Because of this resiliency, utilized for fixing the shade 95, a slight gap is formed between the upper end of the shade and the engaging groove 92A, and between the rear end of the shade and the fixed piece 94B. The space permits the ventilation of the air therein.

As shown in FIG. 4, the air taken into the machinery room 40 and heated by the condenser 42 (to about 40° C.) is blown toward the exhaust 45. But a part of the heated air not exhausted from the exhaust 45 is led past the lower end of the rear cover, and into the space K communicating with the rear portion of the machinery room 40. The air is finally led to the door-storage section 25 and exhausted through, or round, the illumination block 26.

Incidentally, the air exhausted from the machinery room is normally heated to about 40° C. when the ambient temperature is 30° C., the dews generated on the drain pipe 82 and the door-storage section 25 are gradually evaporated and transported to front part of the door-storage section. Passing through, or near, the illumination block, the air cools the illumination block while the lamp is on, since the illumination block is higher in temperature than the air, but the air warms the block while the lamp is off.

Figure 18:
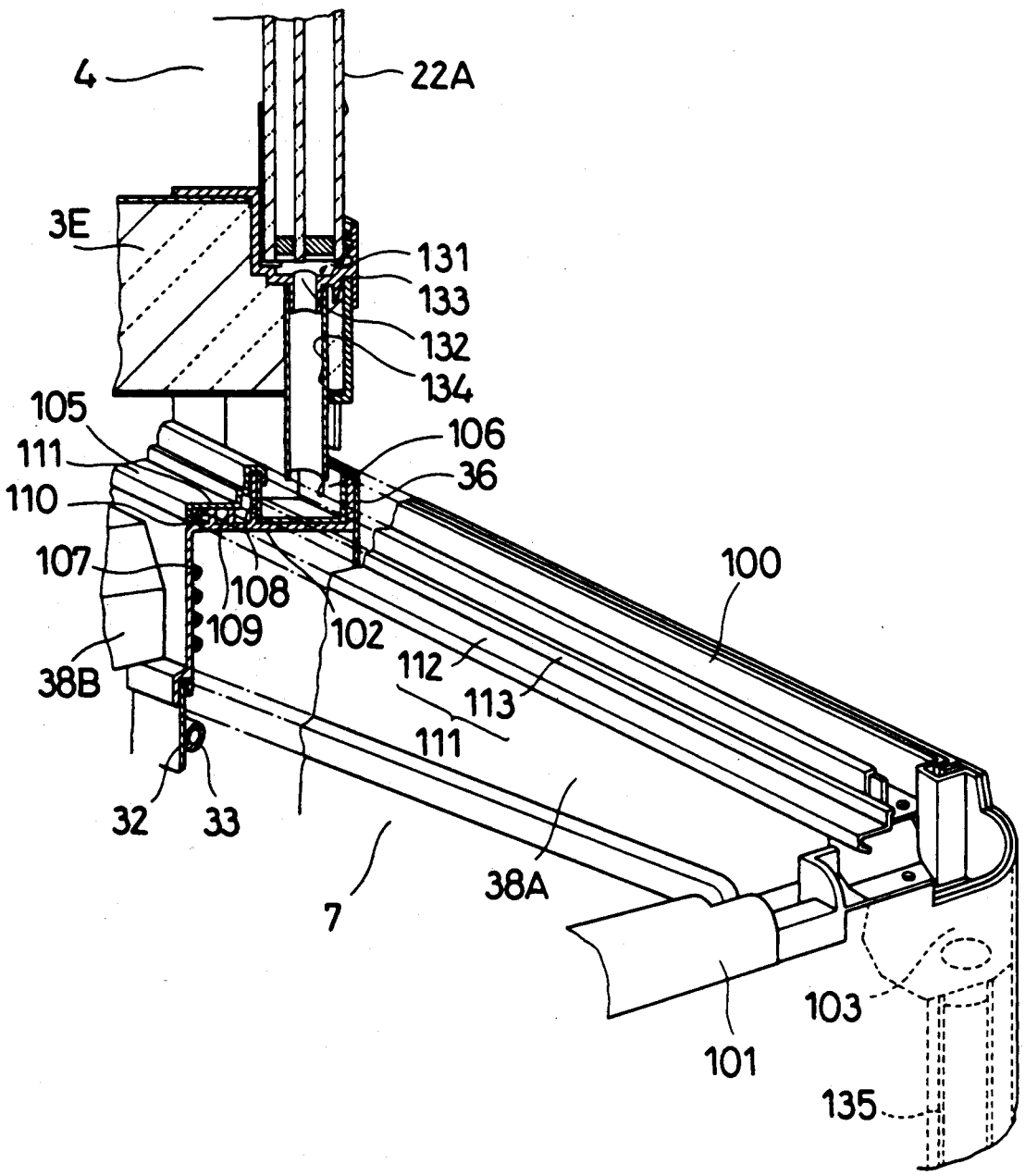
FIG. 18 is a perspective cross section of the first low-temperature show case for illustrating the transportation of dews from the transparent panels of the upper case to the dew receiving portion of the lower case.

Referring now to FIG. 18, a breaker 38 (thermal insulation member) is seen mounted on the upper end of the inner and outer boxes 32 and 36 of the lower case 7. The breaker comprises a first frame 38A which is made up of three portions combined together, and a second frame 38B at the front end of a projecting wall. The first frame 38A further comprises a left frame member (not shown) and a right frame member 100 corresponding to the left and right walls of the box, respectively, and a front frame member 101 corresponding to the front wall of the box. The left and right frame members are arranged symmetrically and opposing each other, as briefly described below.

The right frame member 100 comprises a sloping section 102 sloping up backwardly, a dew-receiving section 103, formed in the fore portion of the sloping section 102, for collecting dews that came down over the sloping section. The frame member 100 also comprises a connecting section (not shown) which is separated from the dew-receiving section 103 and is formed to project from the sloping section so as to be connected with the front frame section 101. On the other hand the sloping section 102 comprises a rail receiver 105 formed on the upper inner surface thereof, a dew guiding groove 106 for guiding dews from the transparent window 22A to the dew-receiving tray via the frame 133 and the lead pipe 134, and an insertion piece 107. The upper end of the inner box is inserted into the inner lower end of the insertion piece 107. The rail receiver 105 comprises a stopper 108 for stopping a stop piece formed on one end of a right rail 111, a receiver 109 for receiving the lower surface of the right rail, and an electing piece 110 for hanging a hang piece formed on another end of the rail 111.

The rail 111 is provided with a support 112 for slidably supporting the transparent doors 30, and a web 113 for limiting the transverse motion of the doors.

A style frame (which will be referred to as hand rail 31) is made of a rust-resisting metal such as stainless steel, and consists of a front style frame 121 for covering the front frame member 101, a right and a left style frames 122 for covering the dew guiding grooves 106 of a right and left frame, respectively, and for forcibly securing the right and left rails 111 on the inner upper ends of the frames 122. The front style frame 121 comprises a bent portion 124 sloping down towards the front end, a door stopper 125 depending from the rear end of the bent portion, a dew receiving tray 126, a nail 127 formed at the front end of the bent portion 124. The right and the left style frames 122 each consists of forcible pieces 128 for forcing the right and left rails 111, respectively, on the inner end and covers 129 for covering the dew guiding grooves 106 of the right and left frames 122.

The front frame member 101 consists of a support 116 for supporting from below the bent portion 124 of a hand rail 31, a groove 117 which is formed at one end of the support 116 and engages with a nail 127 of the hand rail 31, a flexible depending portion 118 formed downwardly, a support 119 for supporting from below the dew receive tray 126 of the hand rail 31. A first portion 101A engages with the upper end of the inner box, and a second portion 101B engages with the upper end of the outer box.

Figure 19:
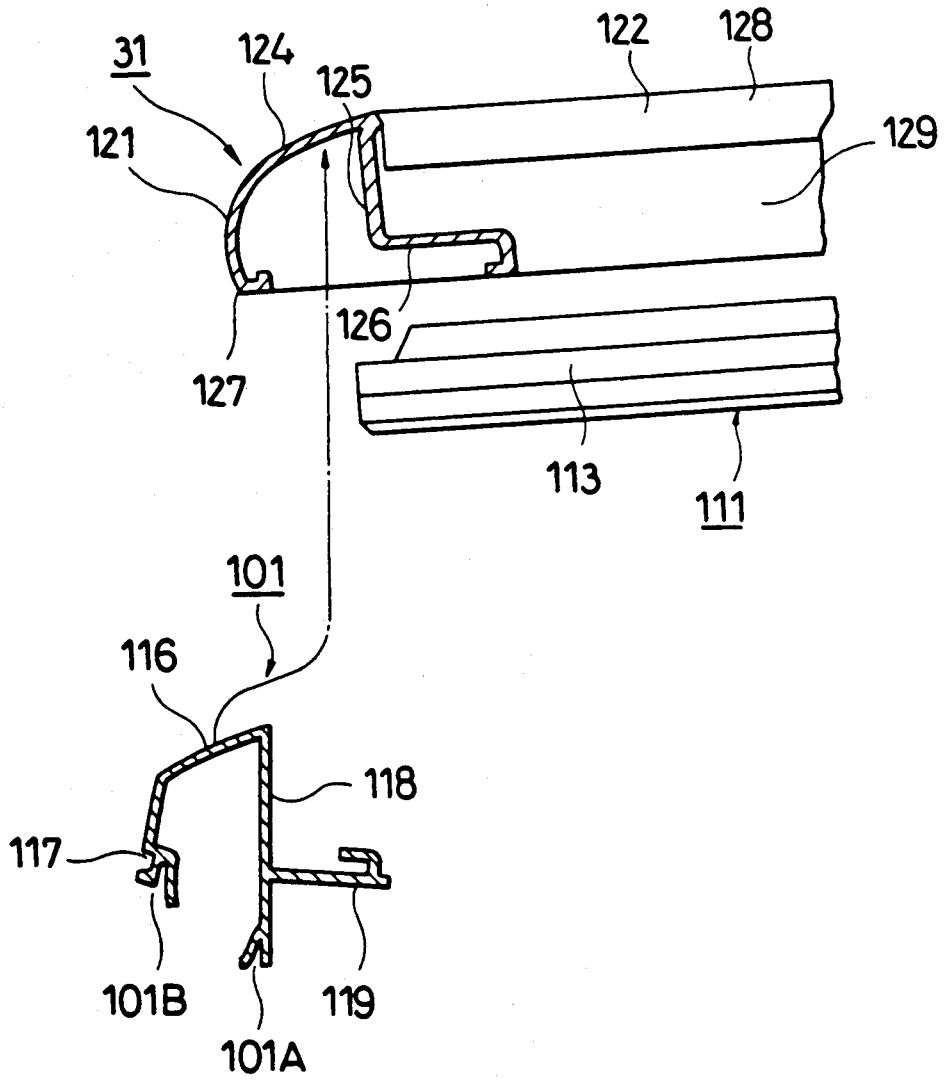
FIG. 19 is a side view showing a handrail and a front frame of the first low-temperature show case.
Figure 20:
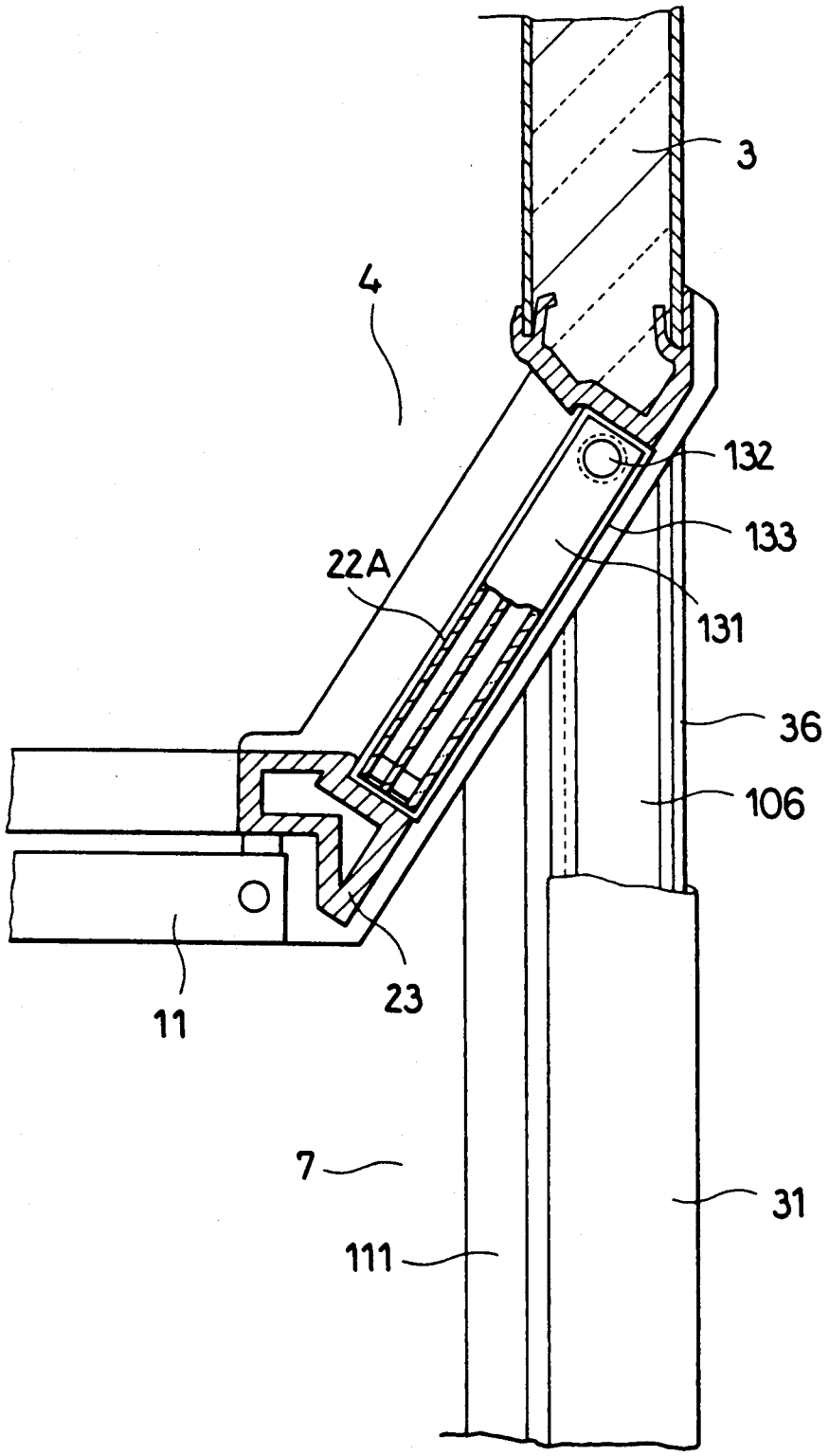
FIG. 20 is an enlarged view of the portion E of FIG. 5.

Referring now to FIGS. 18 and 19 the constitution of the members for leading dews from the transparent windows 22A to the drain water tray 43 is described.

A frame 133 accommodates the transparent windows 22A and has a dew receiving groove 131 for receiving dews deposited on the inner and outer surfaces of the transparent window as viewed from the storing room, and a drain port 132 formed at an appropriate position in the dew receiving groove 131. A lead pipe 134 communicates at one end thereof with the drain port 132 and at the other end with the dew guiding groove 106, through the bottom wall 3E of the upper case 4. At the tip of the dew guiding groove 106 is a dew receiving tray 103, which is connected with a second drain pipe 135 extending to a drain water tray 43. To note, there is provided a small gap between the inner surface of the frame 133 and outer surface of the transparent window 22A so as to permit the dews coming down on the transparent window 22A to easily escape into the dew receiving groove 131 of the frame 133 and further to the drain port 132.

Figure 21:
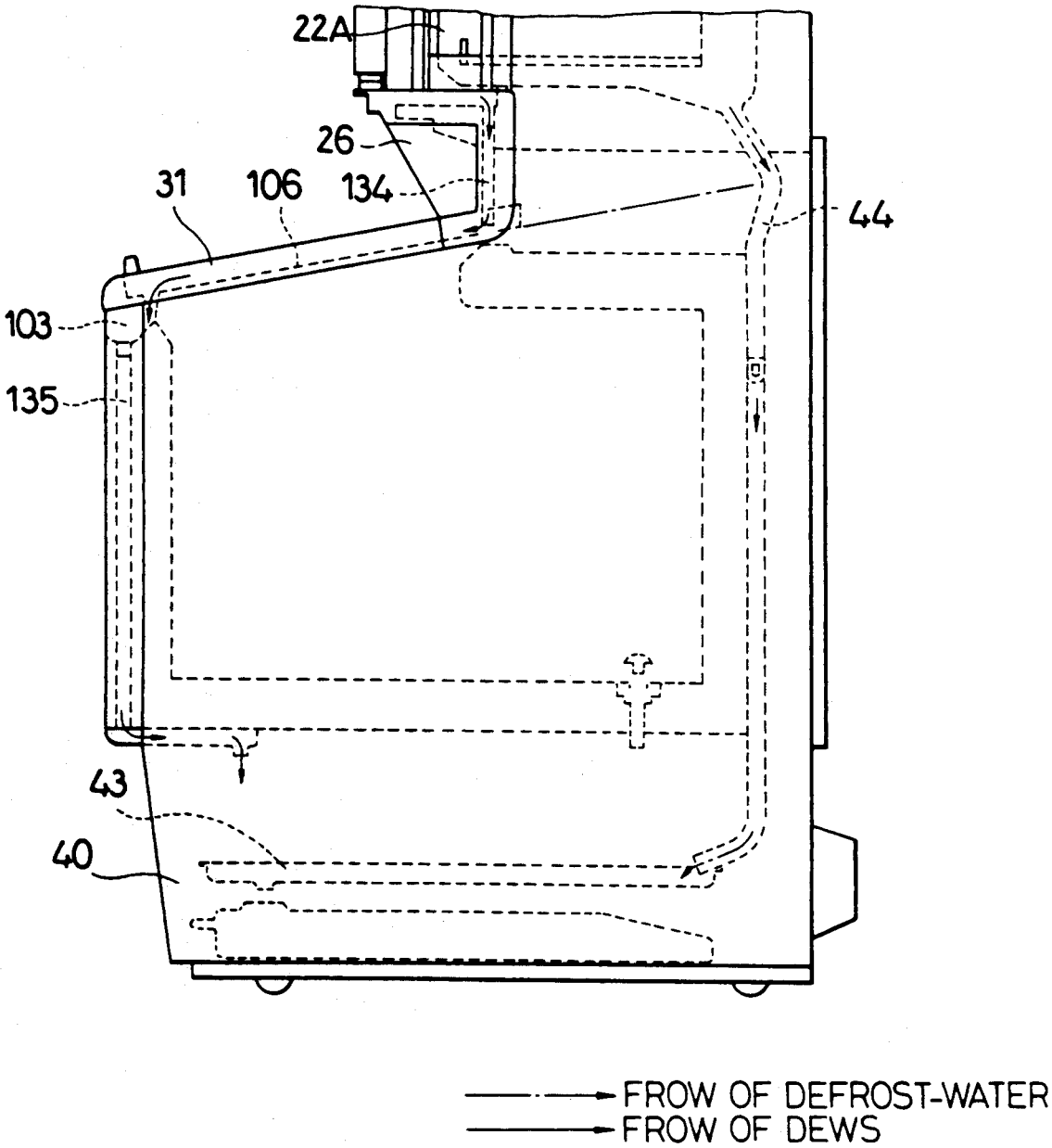
FIG. 21 is a schematic view showing the routes of the melt frost and dews from the upper case to the lower case of the first low-temperature show case.

As shown in FIG. 21 the dews deposited on the transparent window 22A and will come down to the dew receiving groove 131 of the frame 133, from which dews are led to the dew guiding groove 106 through the lead pipe 134, and then transported on the slope of the dew receiving portion 103 under gravity and to the drain water tray 43 through the second drain pipe 135. Since the dews are not exposed to the cold air during this transportation, they do not deposit nor freeze on other components such as refrigeration apparatus.

We claim:

1. A low-temperature show case comprising:

a thermally insulated box having an opening on one side of the box;

a partition board lined along the inner surface of said thermally insulated box;

a first cold-air passage formed between said thermally insulated box and said partition board, and having an outlet and an inlet of said first air passage located within said box, said outlet and inlet facing each other at opposite ends of said opening, respectively, the width of said outlet being greater than that of said opening, and a refrigeration apparatus and a blower for circulating cold air in said passage;

a goods-storing room surrounded by said partition board;

a cold-air curtain being formed across said opening when said refrigeration apparatus and blower operate.

2. A low-temperature show case as defined in claim 1 wherein said outlet and inlet facing each other are at the upper and the lower ends of said opening.

3. A low-temperature show case defined in claim 2, further comprising:

a ceiling board having steps, each said step including an upper level board, a lower level board and a depending portion connecting said boards, the upper level board of each step being located in said first air passage downstream of the depending portion, and the lower level board thereof being located upstream of the depending portion; and a multiplicity of holes in each depending portion of the steps, the holes extending into at least one of the upper and lower level boards.

4. A low-temperature show case defined in claim 2 further comprising in said thermally insulated box:

a sloping conduit located under the refrigeration apparatus, and sloping towards a drain port, and a defrosting heater located between said sloping conduit and said refrigeration apparatus, and having a horizontal portion just beneath the lower surface of said refrigeration apparatus and a sloped portion extending from the horizontal portion substantially in parallel with said sloped conduit.

5. A low temperature showcase as in claim 1 and further comprising a lower case having an upper opening which is formed in the upper front half end of the case and which is subject to opening and closing by transparent slidable doors;

said thermally insulated box being located above the upper rear half end of said lower case;

a door-storage section for storing said doors, located between said insulated box and lower case and having an illumination means at its front end;

a left and a right wall continuously forming the sides of both the insulated box and lower case;

a machinery room under the lower case, for accommodating at least a portion of a refrigeration unit including a compressor and a condenser for cooling the lower case; and a second air passage formed with the rear wall of said lower case, the bottom of said insulated box, and said side walls, the upper end of said second passage being connected with the door-storage section and the lower end thereof with the machinery room, for introducing warm air in said machinery room into said door-storage section.

6. A low temperature showcase as in claim 1 and further comprising a lower case said upper case having transparent revolving doors at its front end, transparent side windows in the sides of said upper case, and frames having troughs for receiving the lower ends of said transparent windows; and said lower case having transparent slidable doors on its upper front end, sloped dew guiding grooves which are sloped down towards the front and formed on the side walls and to the right and left end of said transparent doors, and just below said frame, and style frames covering said dew guiding grooves, and a drain pipe connected at its upper end with said dew guiding grooves and with its lower end extending to a drain water tray provided in the machinery room.

7. A low-temperature show case comprising:

a thermally insulated box having an opening on one side of the box;

a partition board lined along the inner surface of said thermally insulated box;

a first cold-air passage formed between said thermally insulated box and said partition board, and having an outlet and an inlet of said first air passage, said outlet and inlet facing with each other at opposite ends of said opening, respectively, and a refrigeration apparatus and a blower for circulating cold air in said first passage;

a goods-storing room surrounded by said partition board;

a cold-air curtain being formed across said opening when said refrigeration apparatus and blower operate, wherein the width of said outlet is greater than that of said opening; and angular walls, which are at least partially transparent, formed on the front ends of the opposite side-walls of said thermally insulated box, said angular walls narrowing towards the opening and being in contact with opposite edges of the air curtain.

8. A low-temperature show case as defined in claim 7 wherein said outlet and inlet facing each other are at the upper and the lower ends of said opening.

9. A low-temperature show case as defined in claim 8, further comprising:

a ceiling board having steps, each said step including an upper level board, a lower board and a depending portion connecting said boards, the upper level board of each step being located in said first air passage downstream of the depending portion, and the lower level board thereof being located upstream of the depending portion; and a multiplicity of holes in each depending portion of the steps, the holes extending into at least one of the upper and lower level boards.

10. A low-temperature show case defined in claim 13 and further comprising in said thermally insulated box:

a sloping conduit located under the refrigeration apparatus, and sloping towards a drain port, and a defrosting heater located between said sloping conduit and said refrigeration apparatus, and having a horizontal portion just beneath the lower surface of said refrigeration apparatus and a sloped portion extending from the horizontal portion substantially in parallel with said sloped conduit.

* * * * *